US006418574B2

(12) United States Patent
McDowell

(10) Patent No.: US 6,418,574 B2
(45) Date of Patent: Jul. 16, 2002

(54) SHOWER BUDDY BACK CLEANING DEVICE FOR USE IN A SHOWER OR BATH

(76) Inventor: Larry R. McDowell, 822 N. Kankakee St., Wilmington, IL (US) 60481

( * ) Notice: Subject to any disclaimer, the term of this patent is extended or adjusted under 35 U.S.C. 154(b) by 0 days.

(21) Appl. No.: 09/829,134

(22) Filed: Apr. 9, 2001

Related U.S. Application Data

(60) Provisional application No. 60/196,121, filed on Apr. 11, 2000.

(51) Int. Cl.[7] ..... A47K 7/03

(52) U.S. Cl. ..... 4/606; 4/628; 15/104.92; 401/48; 401/133; 401/148; 401/162; 401/183; 401/264

(58) Field of Search ..... 4/606, 628; 15/104, 15/92; 401/48, 133, 148, 162, 183, 264

(56) References Cited

U.S. PATENT DOCUMENTS 2,112,620 A * 3/1938 Friedberg ..... 401/162 X
4,830,674 A * 5/1989 Kaufman ..... 15/104.94 X
5,490,302 A * 2/1996 Dion ..... 4/606 X
5,704,903 A * 1/1998 Jahnke ..... 4/606 X
6,289,547 B1 * 9/2001 Narula et al. ..... 15/104.94 X

* cited by examiner

*Primary Examiner*—Charles R. Eloshway
*Assistant Examiner*—Kathleen J. Prunner
(74) *Attorney, Agent, or Firm*—Jeffrey P. Calfa

(57) ABSTRACT

A back cleaning device having two shells, one inner and one outer with a soap solution bladder affixed between the respective shells. The bladder holds a liquefied soap solution that may be dispersed from an upper dispersal nozzle. The inner shell contains mounting brackets that allow it to be engaged to separate height locations on at least one separate rail that may be affixed to a wall in a shower or bath. The outer shell will include at least one scrub pad engaged to an outer surface. The person needing a back cleaning will lean her back against the scrub pad pushing the outer shell towards the inner shell compressing the bladder. The person will move their back up and down against the scrub pad. This bladder compression forces soap solution out of the upper dispersal nozzle. The soap solution runs over the scrub pad, soaping the scrub pad. The person needing the cleaning has their back cleaned due to the up and down movement against the soaped scrub pad. The person to be cleaned completes the entire process without the use of hands.

14 Claims, 1 Drawing Sheet

FIG. 1
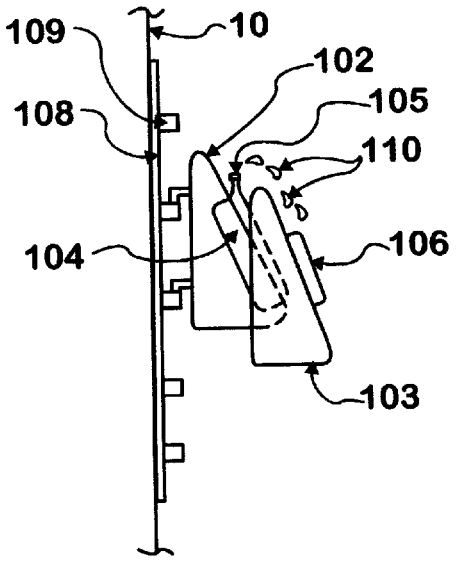
FIG. 2
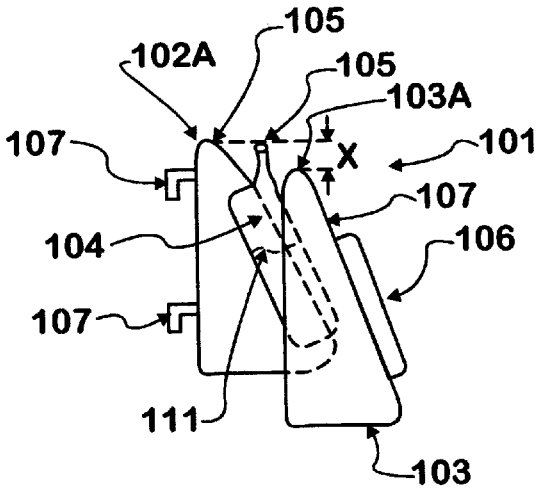
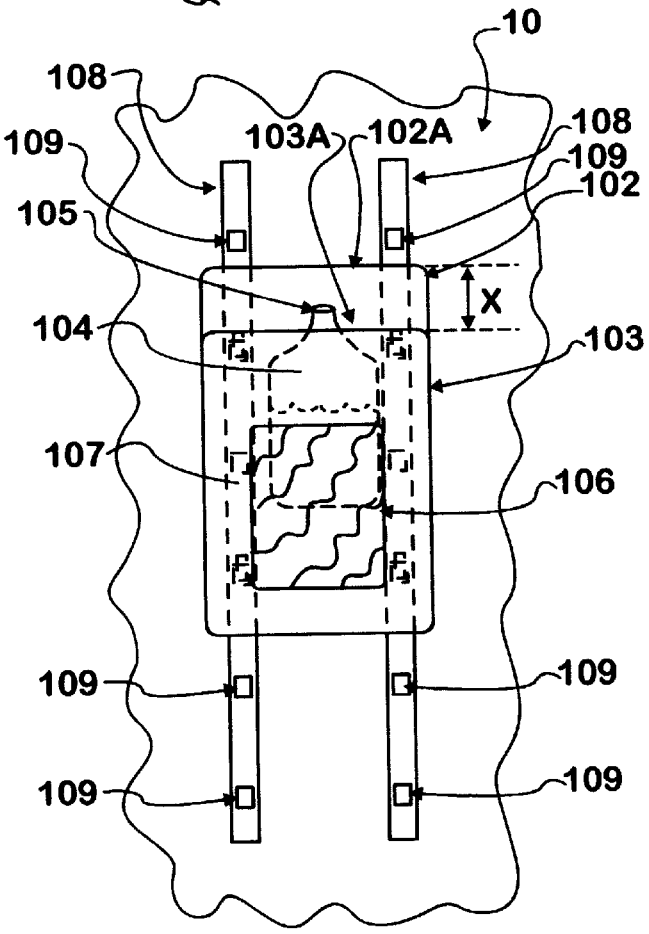
FIG. 3
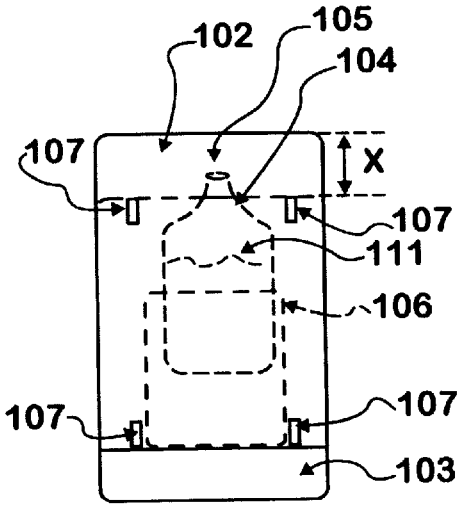
FIG. 4

SHOWER BUDDY BACK CLEANING DEVICE FOR USE IN A SHOWER OR BATH

This is a non-provisional patent application claiming priority under provisional patent application, Ser. No. 60/196,121, filed Apr. 11, 2000.

BACKGROUND OF INVENTION

This invention relates to a shower buddy back cleaning device for use in a shower or bath. More specifically, the shower buddy allows a person in the shower or bath to soap and scrub their backs without the use of their hands. There are also obvious benefits to people who are physically challenged.

PRIOR ART

In the prior art, when an individual needed to soap, scrub, and clean their backs they could stretch around to reach those hard to reach areas on their backs. This is a very awkward evolution even for the most flexible of people. Alternatively, they could have someone else soap, scrub, and clean those hard to reach areas.

People would greatly benefit from a back cleaning device that allows them to soap, scrub, and clean their backs without the use of their hands.

SUMMARY OF INVENTION

A primary object of the invention is to provide a back cleaning device that allows individuals to soap, scrub, and clean their backs without the use of their hands. A secondary object is provide a back cleaning device that is adjustable for various heights to allow people of different heights to enjoy the benefits of the device. The back cleaning device of this invention satisfies this objective by having, two shells, one inner and one outer with a soap solution bladder affixed to and between the respective shells. The bladder holds a liquefied soap solution that may be dispersed from an upper dispersal nozzle. The inner shell contains wall mounting components including mounting brackets that allow it to be engaged to separate height locations on at least one separate rail that may be affixed to a wall in a shower or bath. The outer shell will include at least one scrub pad engaged to an outer surface. The person needing a back cleaning will lean her back against the scrub pad pushing the outer shell towards the inner shell compressing the bladder. The person will move their back up and down against the scrub pad. This bladder compression forces soap solution out of the upper dispersal nozzle. The soap solution runs over the scrub pad, soaping the scrub pad. The person needing the cleaning has their back cleaned due to the up and down movement against the soaped scrub pad. The person to be cleaned completes the entire process without the use of hands.

DRAWINGS

FIG. 1 is a side view of a shower buddy back cleaning device engaged to its rails that are in turn engaged to a wall made in accordance with this invention.

FIG. 2 is a side view of the back cleaning device of FIG. 1, shown without rails.

FIG. 3 is a front view of the back cleaning device of FIG. 1.

FIG. 4 is a back view of the back cleaning device of FIG. 1, shown disengaged from the rails.

DETAILED DESCRIPTION OF THE INVENTION

The shower buddy back cleaning device 101 shown in FIGS. 1 to 4 is made in accordance with this invention. The back cleaning device 101 is shown mounted to a shower or bath wall 10 in FIGS. 1 and 3. There are two shells, one inner shell 102 and one outer shell 103 with a soap solution bladder 104 affixed to and between the shells. The outer shell 103 may contain a downward sloping outer surface 107. The outer surface contains a scrub pad or scrub brush 106. The bladder 104 holds a liquefied soap solution, shown with an upper level 111. The soap solution may be dispersed from an upper soap solution dispersion nozzle 105. When dispersed, the soap solution 110 will flow over the outer surface 107 and scrub pad 106. The inner shell 102 contains wall mounting components including at least one mounting bracket 107 that allow it to be engaged to separate height mounting locators 109 disposed at different heights on at least one separate rail 108 that may be affixed to the wall 10 in a shower or bath. There may be only one mounting locator 109 on the rail but multiple mounting locators 109 are preferred for height adjustment and various shell mounting locations.

The prototype of the back cleaning device 101 was constructed of two plastic paint pans as the inner and outer shells, 102 and 103, respectively. The prototype bladder 104 was a hot water bottle with the dispersal nozzle 105 having been the water bottle fill connection.

There is no requirement that the inner shell 102 be the same shape as the outer shell 103. The inner shell 102 merely need provide a rigid surface for the outer shell 103 to compress the bladder 104 to sufficiently force soap solution 110 from the bladder 104. The sloping downward surface 107 of the outer shell 103 is preferred to channel the soap solution 110 to the scrub pad 106, however it is not required so long as the dispersed soap solution 110 is directed to the scrub pad 106.

Where the inner shell 102 is the same shape as the outer shell 103, the upper edge 102A of the inner shell 102 will be higher than the upper edge 103A of the outer shell 103 by a distance X as shown in FIGS. 2 to 4. This displacement will also facilitate the flow of the dispersed soap solution 110 over the scrub pad 106.

In the preferred embodiment, there are four mounting brackets 107 on the rearward side of the inner shell 102. In this preferred embodiment, there are two rails 108 for horizontal stability of the back cleaning device 101. Although most engagement methods between the height mounting locators 109 and the mounting brackets 107 are acceptable, the mounting brackets 107 are male connectors and the height mounting locators 109 are female connectors in the embodiment shown in FIGS. 1 to 4.

The person needing a back cleaning will lean her back against the scrub pad 106 pushing the outer shell 103 towards the inner shell 102 compressing the bladder 104. The person will move their back up and down against the scrub pad 106. The bladder 104 compression forces soap solution 110 out of the upper dispersal nozzle 105. The soap solution 110 runs over the scrub pad 106, soaping the scrub pad 106. The person needing the cleaning has their back cleaned due to the up and down movement against the soaped scrub pad 106. The person to be cleaned completes the entire process without the use of their hands or without the help of another person.

As described above, the shower buddy back cleaning device 101 provides a number of advantages, some of which have been described above and others of which are inherent in the invention. Also modifications may be proposed to the shower buddy back cleaning device 101 without departing from the teachings herein.

I claim:

1. A shower buddy back cleaning device for mounting on a wall in a shower or bath for allowing a person to clean their back without the use hands, comprising:

an inner shell;

an outer shell;

a soap solution bladder affixed to and between said inner shell and said outer shell;

a scrub pad engaged to an outer surface of said outer shell;

said bladder having an upper soap solution dispersal nozzle for dispersing a soap solution in said bladder over said scrub pad upon compression of said bladder between said inner shell and said outer shell; and said inner shell being provided with wall mounting components.

2. The shower cleaning device of claim 1, wherein:

said outer surface of said outer shell including a downward sloping surface.

3. The shower cleaning device of claim 2, wherein said wall mounting components of said inner shell comprise:

at least one rail affixable to the shower or bath wall;

said rail containing a mounting locator; and said inner shell containing at least one mounting bracket for engagement to said mounting locator.

4. The shower cleaning device of claim 3, wherein said inner shell is the same shape as the outer shell.

5. The shower cleaning device of claim 4, wherein:

an upper edge of said inner shell is higher than an upper edge of said outer shell.

6. The shower cleaning device of claim 3, wherein:

said rail contains multiple mounting locators at different heights for various shell mounting locations and said multiple mounting locators being height mounting locators.

7. The shower cleaning device of claim 6, comprising:

a second rail with multiple height mounting locators.

8. The shower cleaning device of claim 7, wherein:

said inner shell contains multiple mounting brackets, said mounting brackets being male connectors; and said height mounting locators being female connectors receptive of said male connectors.

9. A method for cleaning a person's back without the use of hands, comprising the steps of:

leaning the person's back against a scrub pad engaged to an outer shell of a shower buddy back cleaning device, the outer shell being engaged to an inner shell through a soap solution bladder, the bladder containing liquefied soap solution and having an upper soap solution dispersion nozzle, and the inner shell being engaged to a shower or bath wall through wall mounting components;

moving the person's back up and down against the scrub pad;

providing pressure against the scrub pad and outer shell so as to compress the bladder between the inner shell and the outer shell to force the liquefied soap solution out of the bladder over the scrub pad soaping the scrub pad;

rubbing the person's back against the scrub pad applying soap to the back of the body; and rinsing the soap from the back with water.

10. The method for cleaning a person's back of claim 9, wherein:

an outer surface of the outer shell includes a downward sloping surface for facilitating the flow of the soap solution to and over the scrub pad.

11. The method for cleaning a person's back of claim 10, wherein the wall mounting components of the inner shell comprise:

at least one rail affixable to the shower or bath wall;

the rail containing a mounting locator; and the inner shell containing at least one mounting bracket for engagement to the mounting locator.

12. The method for cleaning a person's back of claim 11, wherein:

the rail contains multiple mounting locators at different heights for various shell mounting locations and the multiple mounting locators being height mounting locators.

13. The method for cleaning a person's back of claim 12, wherein the wall mounting components of the inner shell further comprise:

a second rail with multiple height mounting locators.

14. The method for cleaning a person's back of claim 13, wherein the wall mounting components of the inner shell further comprise:

multiple mounting brackets, said mounting brackets being male connectors; and said height mounting locators being female connectors receptive of said male connectors.

* * * * *